United States Patent [19]

Evans et al.

[11] Patent Number: 4,483,817

[45] Date of Patent: Nov. 20, 1984

[54] METHOD AND APPARATUS FOR MAPPING THE DISTRIBUTION OF CHEMICAL ELEMENTS IN AN EXTENDED MEDIUM

[75] Inventors: Larry G. Evans, Laurel; Jacob I. Trombka, Rockville, both of Md.

[73] Assignee: The United States of America as represented by the Administrator of the National Aeronautics and Space Administration, Washington, D.C.

[21] Appl. No.: 462,497

[22] Filed: Jan. 31, 1983

[51] Int. Cl.[3] ..... G21G 1/06; G21T 1/00

[52] U.S. Cl. ..... 376/159

[58] Field of Search ..... 376/159; 250/390-392

[56] References Cited

U.S. PATENT DOCUMENTS

| | | | |
|---|---|---|---|
| 2,781,453 | 2/1957 | Belcher et al. | 250/391 |
| 3,723,727 | 3/1973 | Wogman et al. | 376/159 |
| 3,781,556 | 12/1973 | Taylor et al. | 376/159 |
| 3,889,112 | 6/1975 | Holmes | 376/159 |
| 4,278,885 | 7/1981 | von Alfthan et al. | 250/390 |
| 4,302,285 | 11/1981 | Pronman et al. | 376/159 |
| 4,314,155 | 2/1982 | Sowerby | 376/159 |

OTHER PUBLICATIONS

Use of Small Accelerators in Coal Analysis and Coal Slurry Flow Measurements by C. L. Herzenberg, IEEE Transactions on Nuclear Science, vol. NS-26, No. 1, Feb. 1979, pp. 1568-1573.

*Primary Examiner*—Sal Cangialosi

*Attorney, Agent, or Firm*—John O. Tresansky; John R. Manning; Ronald F. Sandler

[57] ABSTRACT

A neutron/gamma ray technique for mapping the distribution of contaminants in an extended medium such as the wall (10) of a building. A neutron excitation source (14) is located on one side of the wall (10) and a gamma ray spectrometer, including a gamma ray detector (16), is located on the opposite side of the wall (10) facing the excitation source (12). The source and detector are moved in unison in discrete steps over opposing wall surfaces (12, 18) so as to determine the chemical composition of the elements in a hemispheric region (20) of the wall adjacent the detector with the radius of the region being substantially that of the mean free path distance of gamma rays emitted from elements interacting with neutrons on the detector side of the wall. The source (14) and detector (16) are reversed for relatively thick walls for mapping the distribution of elements on the other side of the wall thickness. The output of the detector (16) is fed to a multi-channel pulse height analyzer (24) where the intensity of the various gamma ray spectral lines are indicated relative to a dominant constituent element such as silicon. Concentrations of water in the wall (10) are determined by detecting the presence of hydrogen while salt concentrations are detected by the presence of chlorine. Resolution of anomalies such as the presence of voids and/or determining the bulk density of the medium is achieved by substituting a gamma ray source (38) for the neutron source (14). The neutron/gamma ray technique is also applied to metal alloys, such as iron alloys, in either the solid or molten state.

37 Claims, 7 Drawing Figures

METHOD AND APPARATUS FOR MAPPING THE DISTRIBUTION OF CHEMICAL ELEMENTS IN AN EXTENDED MEDIUM

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 USC 2457) and was also made by an employee of the U.S. Government and may be manufactured and used by or for the Government for governmental purposes without the payment of any royalties thereon or therefor.

TECHNICAL FIELD

The invention relates generally to nondestructive testing and more particularly to neutron/gamma ray mapping methods and apparatus for determining the presence of certain elements in a material sample having an extended area of investigation.

BACKGROUND ART

The degradation of building materials and structures such as historic buildings has currently presented a problem of great interest in order to preserve such buildings for posterity. Such degradation can be attributed to the presence of contaminants and chemical changes in the constituent building materials. In order to determine the nature and extent of the changes in building materials, maps reflecting the presence and distribution of contaminants and chemical changes can provide a very important tool in determining the methods of preservation and restoration which may become necessary as the structures continue to age.

While non-destructive testing techniques involving the use of neutron or gamma ray sources in conjunction with gamma ray detectors are generally known for detecting the characteristics and/or concentration of elements in an extended layer or medium, what is required is an improvement in such techniques for providing maps over an extended area of a relatively thick wall showing water concentrations as reflected by the presence of hydrogen and salt concentrations as reflected by the presence of chlorine. Following the mapping of the contaminant distribution, several different types of treatment can be utilized. For example, poultices can be applied to the surface of the building materials and the contaminants removed thereby. The effectiveness of the removal can be determined by repeating the mapping of the wall surface after treatment. Another method which can be employed is the diffusion of monomers into the materials, thus filling the regions where the destructive action of water and salt have changed the chemical composition and left voids. These voids can compromise the structural integrity of the structure. However, heat polymerization must, for example, be used to solidify the structure and an incomplete diffusion of the monomer into the building materials can present an additional problem. This additional problem relates to inadequate drainage. If the monomer is polymerized only on the surface portions of the wall, the water content of the walls could be trapped within the walls rather than being allowed to evaporate and/or drain. In any event, a non-destructive mapping technique is more highly desirable than making core drillings into the wall or other extended medium and the materials thereafter removed for chemical analysis in a laboratory. The coring techniques are thus destructive and samples only relatively small areas. While certain neutron albedo techniques have also been used to determine hydrogen content in materials, such methods are only sensitive to high concentrations of hydrogen and thus cannot be used over the range of concentration interest in building materials.

STATEMENT OF THE INVENTION

Accordingly, it is an object of the present invention to provide a method and apparatus for determining the distribution of chemical elements in extended media.

Another object of the present invention is to provide an improved method and apparatus for performing qualitative and quantative distribution of chemical elements in a media by analyzing the gamma ray emission spectra of neutron irradiated material.

A further object of the invention is to provide an apparatus for mapping the distribution of contaminants in building materials.

Still another object of the invention is to provide an improved method and apparatus for mapping the concentrations of water and salt in a relatively thick wall.

A still further object of the invention is to provide an improved method and apparatus for determining the constituent elements in a metal alloy in either a solid or molten state.

These and other objects are achieved in accordance with a method and apparatus for determining the elemental composition and mapping the distribution of certain chemical elements in an extended medium. An extended medium can be defined as a sample whose dimensions in both width and depth are comparable to the mean free path of the neutrons in that medium. In most cases, the mean free path of the neutron is greater than the mean free path of the gamma rays. For extremely thin samples, the number of gamma rays excited in the sample may be too low for performing rapid analysis and further may produce a background due to source neutrons and gamma rays which may be significantly higher than the gamma rays generated by the sample. One example of an extended medium may be a thick brick wall utilizing a neutron excitation source on one side of the wall and a gamma ray spectrometer on the opposite side of the wall facing the neutron excitation source. The neutron excitation source and an opposing gamma ray detector forming a part of the spectrometer are moved in unison over opposing wall surfaces in discrete steps so as to determine the elemental composition in a hemispheric region of wall thickness, the radius of the region being substantially that of the mean free path distance of the gamma rays emitted from elements interacting with neutrons on the detector side of the wall. This particular geometry also significantly reduces the background flux from the neutron source. The source and detector are reversed, when necessary, for mapping the distribution of elements on the other half of the wall thickness. The output of the detector is fed to a multi-channel pulse height analyzer where the respective intensities of the various spectral lines are indicated, and from these lines, the intensity relative to a standard or dominant element are calculated. In the case of building materials the dominant element for a brick or block wall is silicon and other elements present may be contaminants. Further, for the resolution of anomalies such as the presence of voids and/or determining the bulk density of the medium, a gamma ray source is substituted for the neutron source or is used in combination with the neutron source and the measurement is made simultaneously.

The foregoing as well as other objects, features and advantages of the invention will become apparent from the following description taken in conjunction with the drawings.

DETAILED DESCRIPTION OF THE INVENTION

Figure 1:
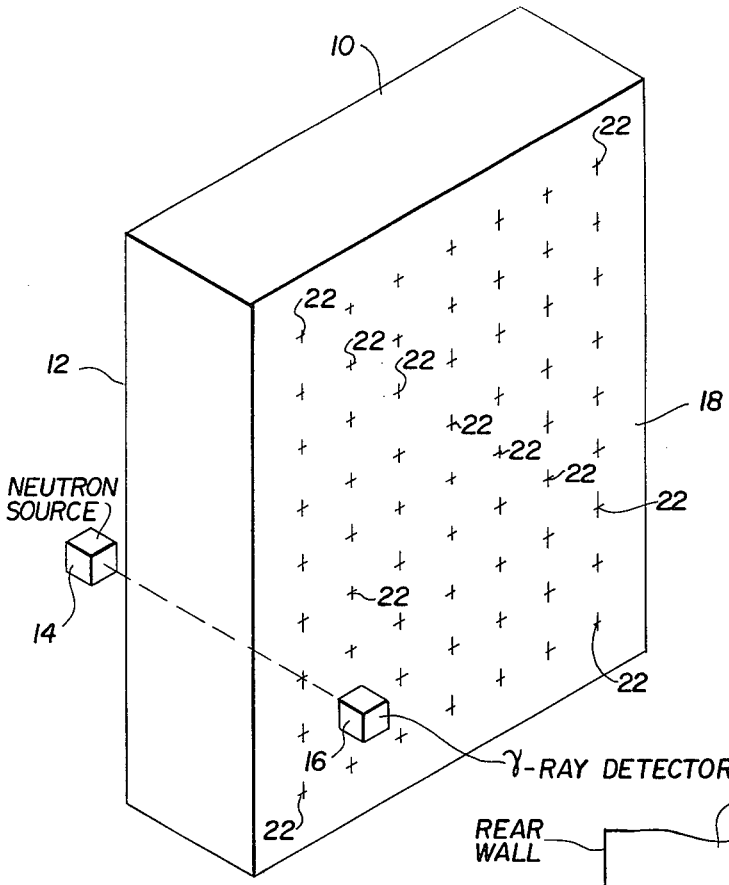
FIG. 1 is a perspective view of an extended medium such as a wall of a building and is illustrative of the pattern employed for mapping the distribution of certain chemical elements such as contaminants in accordance with the invention.

Referring now to the drawings and more particularly to FIG. 1, reference numeral 10 designates an extended medium, for example, a brick wall of a building which is to be investigated for contaminants such as salt and water and having a relatively large thickness in the order of 16 inches. On the rear wall surface 12 of the wall 10 is located a neutron source 14 which is comprised of an easily moved source of fast neutrons such as $252_{Cf}$ or a neutron generator of any conventional type. Directly opposite the neutron source 14 is located a gamma ray detector 16 on the front wall surface 18. The detector 16 forms part of a spectrometer to be subsequently described. Any movement of the neutron source 14 over the back wall surface 12 is accompanied by corresponding movement of the detector 16 so that they are constantly in registration with one another and accordingly move in unison. The verification of proper detector-source alignment can be achieved with the use of a gamma ray source and a collimated detector. Measurement of the maximum gamma ray line intensity would indicate the proper relative position of the detector-source configuration.

As is well known in nuclear physics, high energy neutrons passing through a medium can lose energy due to interactions with the elements in the medium and can eventually become thermalized. Fast (high energy) neutrons can lose energy by inelastic collisions with the various nuclei. These collisions can be accompanied by the emission of gamma rays called inelastic gamma rays. Thermal (low energy) neutrons have a high probability of capture by the various nuclei. This capture is immediately accompanied by the emission of gamma rays called capture gamma rays.

Figure 2A:
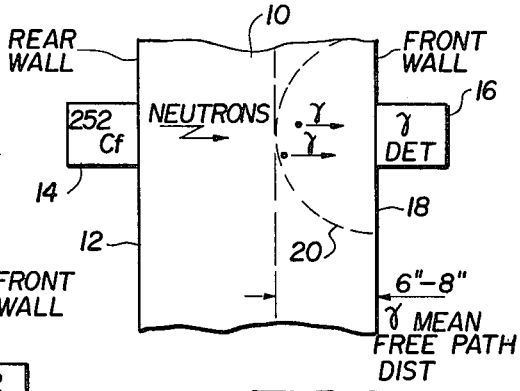
FIGS. 2A and 2B are diagrams illustrative of the method for determining the chemical composition of certain elements on both halves of the thickness of the wall shown in FIG. 1.
Figure 2B:
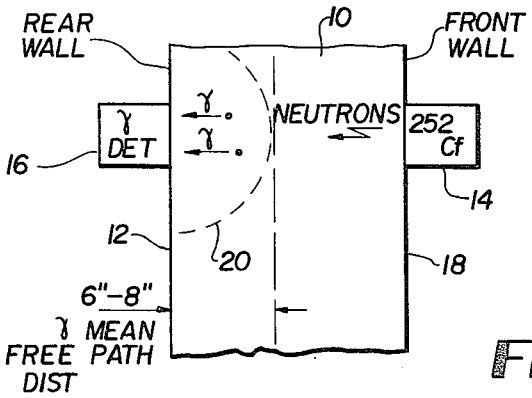

Accordingly, neutrons from the source 14 produce characteristic gamma radiation of both types of the various constituent elements as it passes through the wall thickness. Where, for example, it is required to detect contaminants such as water and salt within the confines of the wall 10, it can be accomplished by determining the presence of hydrogen and chlorine, respectively. However, the gamma ray mean free path distance for these elements is in the order of 6 to 8 inches and accordingly, the detector 16 is only able to detect gamma emission from the desired elements, hydrogen and chlorine, within a hemispherical region 20 adjacent the detector 16 which is equal to the mean free path distance as shown in FIG. 2A. It should be noted that a hemispherical region is relevant only for material which is homogeneous in density. Thus the front wall surface 18 to a depth of the gamma ray mean free path distance (6"–8") can be effectively mapped as shown in FIG. 1 by positioning the neutron source 14 and the detector 16 in substantially equally spaced points 22 arranged in a plurality of columns and rows where the mutual separation between the points 22, for example, is twice the mean free path distance, e.g. 12 inches. A matrix of points over the entire face 18 will result in providing a map of the elements emitting gamma rays in the forward half thickness of the wall 10. To map the elements in the rear half thickness of the wall 10, the relative position of the neutron source 14 and the gamma ray detector 16 is simply reversed as shown in FIG. 2B and the process repeated with substantially the same points 22 shown in FIG. 1 being established on the rear wall surface 12. In any event, the position of the source 14 and the distance of the source with respect to the detector 16 must be kept constant.

Since each chemical element will produce its own characteristic gamma ray spectral emission, an analysis of the gamma ray spectrum at each test point 22 can provide both a qualitative and quantitative indication of various elements, particularly hydrogen and chlorine, where the concentration of water and salt at the wall 10 is desired.

Figure 3:
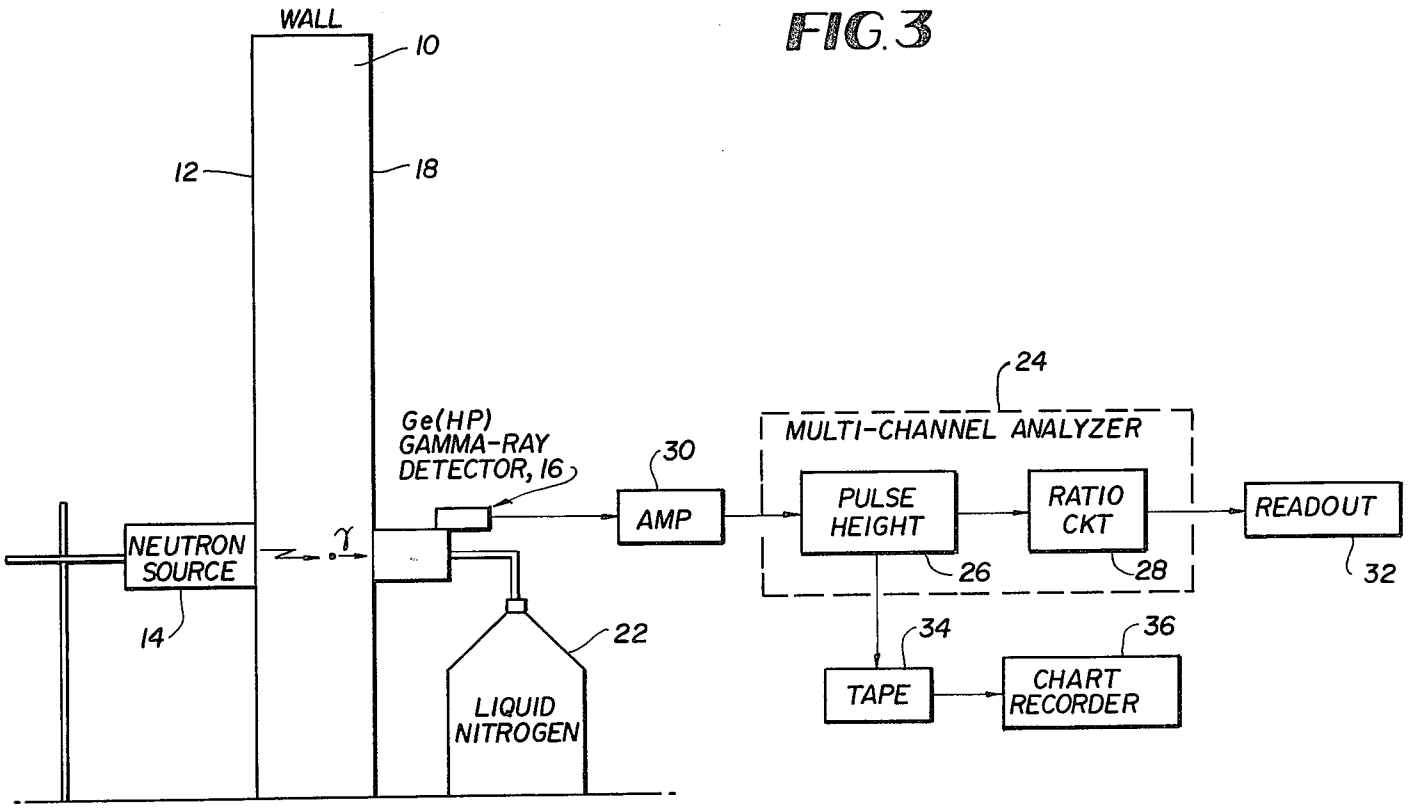
FIG. 3 is a diagram illustrative of apparatus utilized for determining the composition of elements in the wall shown in FIG. 1.

Referring now to FIG. 3, the gamma ray detector 16 as shown is comprised of a Ge(HP) semiconductor detector cooled by a liquid nitrogen source 22. The detector 16 forms one portion of a gamma ray spectrometer which additionally includes a multichannel analyzer 24, for example, a TRACOR model TN 1710. Such equipment, inter alia, includes a pulse height analyzer section 26 and a computation section 28 which can be programmed to compute the ratio of the intensity of various elemental spectral lines. The gamma ray detector 16 is shown coupled to the analyzer 24 by means of a signal amplifier 30. The pulse height analyzer section 26 is operable to output data indicative of the relative position and the intensity of the various spectral line(s) of the elements detected. This data is fed to the ratio computing circuit 28 where the intensity of predetermined spectral lines is computed relative to the concentration of a predetermined element, for example, the dominant element, which in the case for a building wall 10 constructed from refractory materials such as brick, comprises silicon. The ratios are used to make any needed corrections for changes in neutron spectral and spatial distribution and changes in gamma ray absorption between the source and detector. These ratios more closely reflect the chemical changes rather than changes in gamma ray intensity. The ratio calculation performed in the ratio circuit 28 is coupled to a digital read out circuit 32 from which the values can be recorded and tabulated, for example, as shown in Table I.

TABLE I

| Run # | 1.165 | Cl/Si 2.864 | 6.111 | H/Si 2.223 | Ti/Si 1.381 | K/Si .771 | Sn/Si 1.293 | Ca/Si 1.943 | Fe/Si 7.638 (MeV) |
|---|---|---|---|---|---|---|---|---|---|
| 1 | 1.17 | .11 | .32 | 1.45 | .33 | .20 | — | — | .54 |
| 2 | 1.06 | .15 | .38 | 1.25 | .43 | — | — | — | — |
| 3 | 0.0 | 0.0 | 0.0 | 1.59 | .40 | — | .13 | .078 | .38 |
| 4 | .17 | — | .047 | 1.44 | .49 | .13 | .097 | .089 | — |
| 5 | .16 | — | .071 | .86 | .47 | .21 | .25 | .13 | .45 |
| 6 | 0.0 | 0.0 | 0.0 | 1.06 | .60 | .18 | .38 | .17 | — |

Table I, runs 1, 3 and 5 comprise spectral line data taken at three points on a front wall of a typical building under investigation, while runs 2, 4 and 6 correspond to the same corresponding points on the rear wall. In a mapping procedure, however, one would systematically test a great number of points on both wall surfaces. The Table I shows the ratio values for three lines of chlorine which is indicative of salt concentration in the wall, one line for hydrogen which is indicative of water concentration, and lines for titanium, potassium, tin, calcium and iron. Accordingly, the columns reflect the concentration of contaminant elements in relation to silicon. As indicated above, the ratio value is particularly useful because it provides compensation for nonelemental composition effects which might be considered as noise in the measuring apparatus. Comparing values in the same column thus provides an indication of the relative intensities and location of the desired elements.

Figure 5:
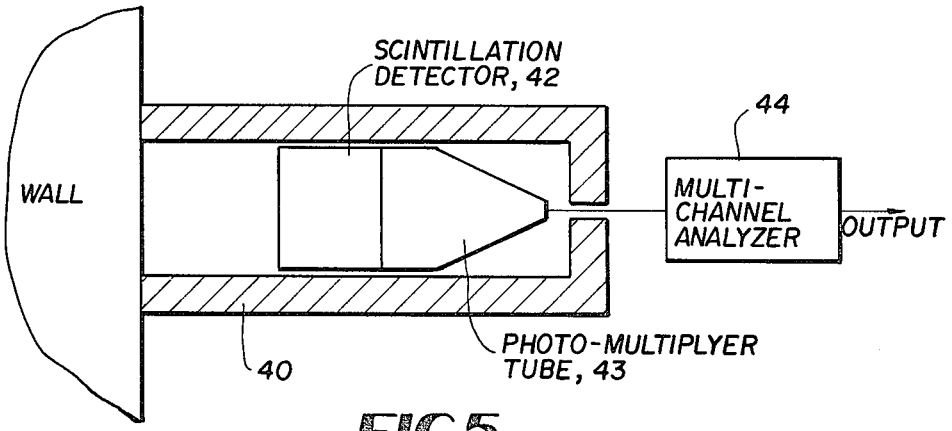
FIG. 5 is a partial electrical block diagram illustrative of a modified form of the apparatus shown in FIG. 2.

To provide a record of the various spectra, the pulse height analyzer section 26 is also coupled to a tape deck 34 which is adapted to be coupled, for example, to a chart recorder 36 for providing a strip record typically as illustrated in FIG. 5 where the top half of the graph is representative of the lower energy portion of the spectrum, while the lower half of the graph corresponds to the upper energy portion of the spectrum.

Figure 4:
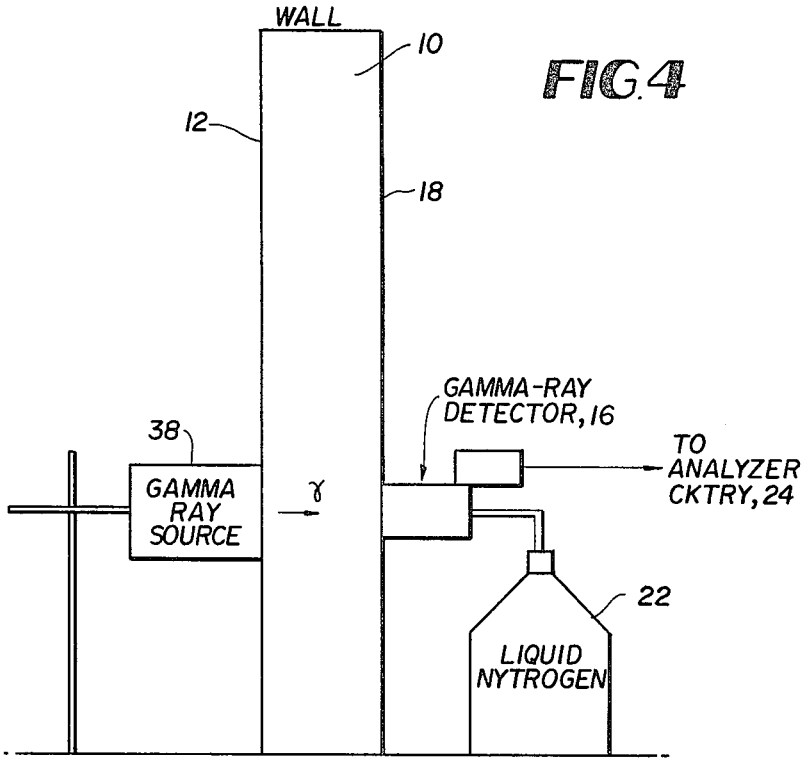
FIG. 4 is a diagram illustrative of the apparatus utilized for determining the density of the elements in the wall shown in FIG. 1.

To resolve any anomalies in the measurement technique involving the fast neutron source 14 and the gamma ray detector 16, as well as determining the bulk density at each of the points 22, this is accomplished simply by replacing the neutron source 14 by a gamma ray source 38 as shown in FIG. 4 and repeating the spectral analysis for the gamma ray source line emission and studying the variation in transmission as reflected by the change in intensity of the gamma ray line measured at the detector.

While the configurations shown in FIGS. 3 and 4 are illustrative of the basic embodiments of the invention, reference to FIG. 5 is illustrative of a modification in the spectrometer apparatus utilized for making the required spectral analysis. With reference to FIG. 5, reference numeral 40 denotes a collimator of either the active or passive type which can be utilized, when desired, when enhanced spatial resolution is required. Secondly, a scintillation type detector 42 can be used in place of the earlier disclosed semiconductor type of detector, the light output of which may be enhanced by a photo-multiplier tube 43. Thirdly, a multi-channel analyzer 44 can be utilized to analyze the spectrum of the detector 42 or photo-multiplier tube 43, having a smaller number of channels than heretofore required and being operable to monitor only the count rate changes in the number of channels selected rather than measuring the total spectrum.

Thus what has been shown and described are non-destructive methods and apparatus for the rapid mapping of bulk properties associated with large structures and which is particularly adapted to determine the presence of contaminants and chemical changes in the building materials from which these structures are constructed. It should be understood that the foregoing detailed description is not limited to the determination of the chemical constituents in the walls of buildings or the like, but when desirable, the same techniques can be applied to other environments such as in the metals industries where non-destructive testing of the composition of slabs or ribbons of metal are required, preferably on-line, and in real time.

For this purpose, gamma rays produced by the capture and inelastic scatter of neutrons may be used to perform both qualitative and quantitative analyses while the metal is still molten and thus be used, for example, to perform ladle metallurgy. A neutron source placed adjacent to one side of the ladle or metallic flow would excite characteristic gamma ray emissions which are then detected by a gamma ray sensor placed on the other side of the ladle or flow. The ratios of the measured intensities of the spectral line, for example, iron to the various spectral lines for the allows can then be used to monitor the metal elemental composition.

Having thus shown and described the invention with respect to its preferred embodiments, it should be understood that modifications may be made and equivalents substituted therefor without departing from the spirit and scope of the invention. Accordingly, all modifications, changes and alterations coming within the spirit and scope of the invention as defined in the appended claims are herein meant to be included.

Figure 6:
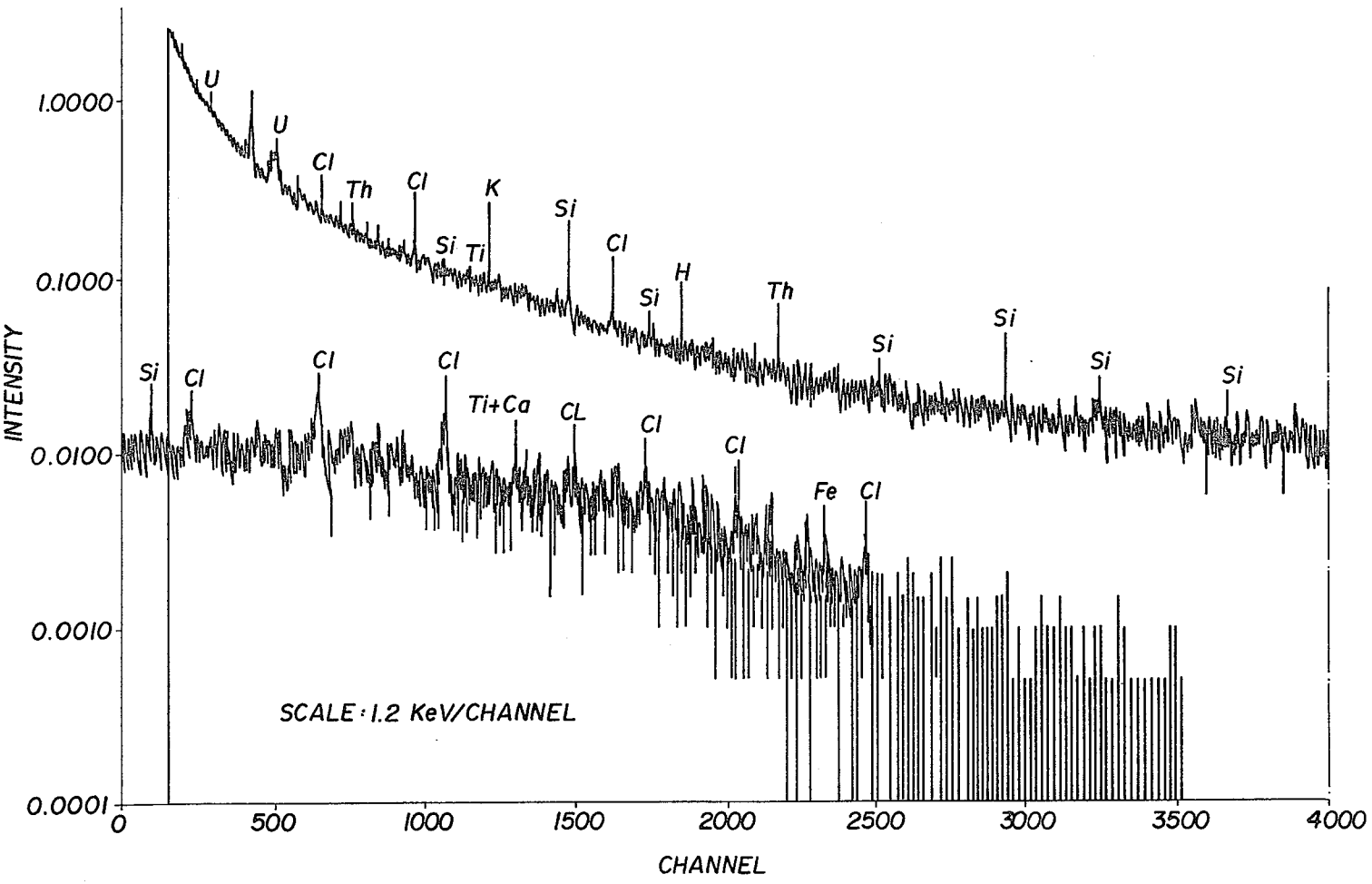
FIG. 6 is a typical graphical illustration of the gamma ray pulse height spectrum with the characteristic lines for different elements in a brick wall of a building.

What is claimed is:

1. The method of determining the elemental composition in an extended medium (10), comprising the steps of:

(a) placing a neutron source (14) adjacent to and directing neutrons into one surface (12) of said extended medium (10);

(b) placing a gamma ray detector (16) adjacent the opposite surface (18) of said extended medium (10) in fixed relationship with the neutron source (14);

(c) sensing gamma rays ($\gamma$) emitted from elements located substantially within a hemispherical region (20) of said extended medium (10) which is located adjacent the gamma ray detector (16), said hemispherical region having a radius substantially equal to said gamma ray mean free distance;

(d) measuring the gamma ray line spectrum (FIG. 6) of characteristic spectral lines of radiations emitted from the elements in said hemispherical region (20);

(e) determining the presence and identity of predetermined spectral lines in the gamma ray spectrum (FIG. 6) for making a qualitative analysis of selected chemical elements in said hemispherical region (20); and (f) determining the relative intensity of said predetermined spectral lines in relation to the spectral line intensity of a predetermined element for making a quantitative analysis of said selected elements in said hemispheric region (20).

2. The method of claim 1 and additionally including the step of:

(g) reversing the mutual position of the neutron source (14) and gamma ray detector (16), and repeating steps (c) through (f).

3. The method as defined by claim 1 and additionally including the step of:

(h) moving said neutron source (14) and said detector (16) in unison over the respective surfaces (12, 18) of said extended medium (10) and repeating steps (d) through (f) at predetermined locations (22) for mapping the distribution of said chemical elements in said medium.

4. The method as defined by claim 1 wherein said extended medium (10) comprises a wall of a building having constituent materials including silicon and wherein said determining step (e) comprises determining the presence and identity of the spectral lines of hydrogen and chlorine for determining the presence of water and salt, respectively, and wherein said determining step (f) comprises determining the intensity of the spectral lines of hydrogen and chlorine in relation to the spectral line of silicon.

5. The method as defined by claim 4 and additionally including the step of:

(i) reversing the mutual position of the neutron source (14) and gamma ray detector (16) and repeating steps (c) through (f).

6. The method of claim 3 wherein said moving step (h) comprises the step of moving said source (14) and detector (16) in discrete steps (22) over said extended medium (10).

7. The method of claim 6 wherein said discrete steps (22) have a separation distance which is at least equal to said gamma ray ($\gamma$) mean free distance.

8. The method as defined by claim 7 wherein said extended medium (10) comprises a wall of a building having constituent materials including silicon and wherein said step (e) comprises determining the presence and identity of the spectral lines of hydrogen and chlorine for determining the presence of water and salt, respectively, and wherein said determining step (f) comprises determining the intensity of the spectral lines of hydrogen and chlorine in relation to the spectral line of silicon.

9. The method as defined by claim 8 wherein said discrete steps (22) have a separation distance substantially equal to the gamma ray mean free path at the edge of said wall (10) and substantially equal to twice the gamma ray mean free path at points interiorally of the edge of said wall.

10. The method as defined by claim 1 and additionally including the step of:

(j) replacing said neutron source (14) with a gamma ray source (38) for making a determination of the bulk density of said medium (10) and for resolving anomalies by measuring the change in intensity of discrete transmitted spectral lines from the source (38).

11. The method as defined by claim 10 and additionally including the step of:

(k) moving said gamma ray source (38) and said detector (16) in unison over the respective surfaces (12, 18) of said extended medium (10) at positions previously determined for the neutron source (14).

12. The method as defined by claim 1 wherein said extended medium (10) comprises an iron sample including alloying materials and wherein said determining step (e) comprises determining the presence and identity of the spectral lines of the elemental components of the sample.

13. The method as defined by claim 12 wherein said spectral lines include those for iron and said alloying materials.

14. The method as defined by claim 13 wherein said spectral lines for said alloying materials are referenced to said spectral lines for said iron.

15. The method as defined by claim 12 wherein said iron sample, including said alloying materials, is molten.

16. The method as defined by claim 12 wherein said determining step (e) is made in real time and on line.

17. The method as defined by claim 1 wherein said extended medium comprises a metal sample of a primary metal including alloying materials.

18. The method of claim 1 wherein said extended medium is a liquid.

19. The method of claim 18 wherein said liquid is a molten composition.

20. Apparatus for mapping the distribution and determining the elemental composition in an extended medium (10), comprising in combination:

a neutron source (14) adjacent one surface (12) of said medium (10) and operable to direct neutrons into said medium;

a gamma ray detector (16) adjacent the opposite surface (18) of said medium (10) and being in fixed relationship with the neutron source (14) and operable to sense gamma rays ($\gamma$) emitted from chemical elements located substantially within a hemispherical region (20) of said medium in proximity to the gamma ray detector (16), said hemispherical region having a radius substantially equal to said gamma ray mean free distance;

means (26) for providing the gamma ray spectrum of characteristic spectral lines of said chemical elements in said hemispherical region (20) and indicating the presence of predetermined spectral lines therein; and means (28) for computing the relative intensity of selected spectral lines in relation to the spectral line intensity of a predetermined element.

21. The apparatus as defined by claim 20 wherein said medium (10) comprises the wall of a building including a constituent dominant element and wherein said means (28) for computing the relative intensity of selected spectral lines computes relative intensity in relation to the spectral line intensity of said dominant element.

22. The apparatus as defined by claim 21 wherein sa dominant element comprises silicon and said predetermined spectral lines include the lines of hydrogen and chlorine for determining concentration of water and salt respectively in said wall (10).

23. The apparatus as defined by claim 22 wherein said neutron source (14) and gamma ray detector (16) are moved in unison over the respective surfaces (12, 18) of said wall.

24. The apparatus as defined by claim 23 wherein said neutron source (14) and gamma ray detector (16) are moved in discrete steps (22).

25. The apparatus as defined by claim 24 wherein said discrete steps (22) have a separation at least equal to the gamma ray mean free path.

26. The apparatus as defined by claim 20 and additionally including means (38) for determining the bulk density of said medium.

27. The apparatus as defined by claim 24 wherein said means (38) for determining density comprises a gamma ray source located on said one surface (12) of said extended medium substantially directly opposite said gamma ray detector (16).

28. The apparatus as defined by claim 25 wherein said medium (10) comprises the wall of a building.

29. The apparatus as defined by claim 18 wherein said medium (10) comprises an iron sample including alloying materials.

30. The apparatus as defined by claim 27 wherein said spectral lines include those of iron and said alloying materials.

31. The apparatus as defined by claim 28 wherein said spectral lines for said alloying materials are referenced to said spectral lines for said iron.

32. The apparatus as defined by claim 27 wherein said iron sample including alloying materials, is molten.

33. The apparatus as defined by claim 30 wherein said spectral lines are determined on line and in real time.

34. The apparatus as defined by claim 27 wherein the bulk density of said medium is determined.

35. The apparatus as defined by claim 18 wherein sa extended medium comprises a metal sample of a primary metal and further including alloying materials.

36. The method of claim 15 and additionally including the step of:

(g) reversing the mutual position of the neutron source and the gamma ray detector, and repeating steps (c) through (f).

37. The method as defined by claim 15 and additionally including the step of:

(h) moving the neutron source and the gamma ray detector in unison over the respective surface of said extended medium and repeating steps (d) through (f) at predetermined locations for mapping the distribution of said chemical elements in said medium.

* * * * *